US006718309B1

(12) United States Patent
Selly

(10) Patent No.: US 6,718,309 B1
(45) Date of Patent: Apr. 6, 2004

(54) CONTINUOUSLY VARIABLE TIME SCALE MODIFICATION OF DIGITAL AUDIO SIGNALS

(75) Inventor: Roger Selly, Palo Alto, CA (US)

(73) Assignee: SSI Corporation, Tokyo (JP)

( * ) Notice: Subject to any disclaimer, the term of this patent is extended or adjusted under 35 U.S.C. 154(b) by 685 days.

(21) Appl. No.: 09/626,046

(22) Filed: Jul. 26, 2000

(51) Int. Cl.[7] ..... G10L 21/04
(52) U.S. Cl. ..... 704/503; 341/61
(58) Field of Search ..... 704/203, 211, 704/267, 500, 503, 504; 341/61

(56) References Cited

U.S. PATENT DOCUMENTS

| | | | | |
|---|---|---|---|---|
| 4,417,103 A | | 11/1983 | Eppler, Jr. et al. | |
| 4,864,620 A | | 9/1989 | Bialick | |
| 5,175,769 A | | 12/1992 | Hejna, Jr. et al. | |
| 5,341,432 A | | 8/1994 | Suzuki et al. | |
| 5,479,564 A | | 12/1995 | Vogten et al. | |
| 5,630,013 A | | 5/1997 | Suzuki et al. | |
| 5,694,521 A | * | 12/1997 | Shlomot et al. | 704/262 |
| 5,806,023 A | | 9/1998 | Satyamurti | |
| 5,828,995 A | | 10/1998 | Satyamurti et al. | |
| 5,832,442 A | | 11/1998 | Lin et al. | |
| 6,278,387 B1 | * | 8/2001 | Rayskiy | 341/61 |
| 6,360,202 B1 | * | 3/2002 | Bhadkamkar et al. | 704/270 |
| 6,622,171 B2 | * | 9/2003 | Gupta et al. | 709/231 |
| 6,625,655 B2 | * | 9/2003 | Goldhor et al. | 709/231 |
| 6,665,751 B1 | * | 12/2003 | Chen et al. | 710/52 |

OTHER PUBLICATIONS

Ren, Rui, "An Edge Detection Method for Time Scale Modification of Acoustic Signals" Printed May 25, 2000.

Veldhuis, R. et al., "Time–scale and Pitch Modifications of Speech Signals and Resynthesis From the Discrete Short–Time Fourier Transform," *Speech Communication*, Elsevier Science Publishers, vol. 18, No. 3, pp. 257–279 (May 1, 1996).

Verhelst, W., "Overlap–add Methods for Time–scaling of Speech," *Speech Communication*, Elsevier Science Publishers, vol. 30, No. 4, pp. 207–221 (Apr. 2000).

Lin, Amerson H.J. and Tan, Roland K.C., "Time–scale Modification Algorithm For Audio And Speech Signal Applications," Preprint 4644 from 104$^{th}$ Audio Engineering Society Convention, May 16–19, 1998, Amsterdam, pp. 1–15.

* cited by examiner

*Primary Examiner*—Richemond Dorvil
*Assistant Examiner*—Martin Lerner
(74) *Attorney, Agent, or Firm*—David T. Millers

(57) ABSTRACT

A method for time scale modification of a digital audio signal produces an output signal that is at a different playback rate, but at the same pitch, as the input signal. The method is an improved version of the synchronized overlap-and-add (SOLA) method, and overlaps sample blocks in the input signal with sample blocks in the output signal in order to compress the signal. Samples are overlapped at a location that produces the best possible output quality. A correlation function is calculated for each possible overlap lag, and the location producing the highest value of the function is chosen. The range of possible overlap lags is equal to the sum of the size of the two sample blocks. A computationally efficient method for calculating the correlation function computes a discrete frequency transform of the input and output sample blocks, calculates the correlation, and then performs an inverse frequency transform of the correlation function, which has a maximum at the optimal lag. Also provided is a method for time scale modification of a multi-channel digital audio signal, in which each channel is processed independently. The listener integrates the different channels, and perceives a high quality multi-channel signal.

37 Claims, 12 Drawing Sheets

CONTINUOUSLY VARIABLE TIME SCALE MODIFICATION OF DIGITAL AUDIO SIGNALS

FIELD OF THE INVENTION

This invention relates generally to digital audio signal processing. More particularly, it relates to a method for modifying the output rate of audio signals without changing the pitch, using an improved synchronized overlap-and-add (SOLA) algorithm.

BACKGROUND ART

A variety of applications require modification of the playback rate of audio signals. Techniques falling within the category of Time Scale Modification (TSM) include both compression (i.e., speeding up) and expansion (i.e., slowing down). Audio compression applications include speeding up radio talk shows to permit more commercials, allowing users or disc jockeys to select a tempo for dance music, speeding up playback rates of dictation material, speeding up playback rates of voicemail messages, and synchronizing audio and video playback rates. Regardless of the type of input signal—speech, music, or combined speech and music—the goal of TSM is to preserve the pitch of the input signal while changing its tempo. Clearly, simply increasing or decreasing the playing rate necessarily changes pitch.

The synchronized overlap-and-add technique was introduced in 1985 by S. Roucos and A. M. Wilgus in "High Quality Time Scale Modification for Speech," *IEEE Int. Conf. ASSP,* 493–496, and is still the foundation for many recently developed techniques. The method is illustrated schematically in FIG. 1A. A digital input signal 10 is obtained by digitally sampling an analog audio signal to obtain a series of time domain samples x(t). Input signal 10 is divided into overlapping windows, blocks, or frames 12, each containing N samples and offset from one another by $S_a$ samples ("a" for analysis). Scaled output 14 contains samples y(t) of the same overlapping windows, offset from each other by a different number of samples, $S_s$ ("s" for synthesized). Output 14 is generated by successively overlapping input windows 12 with a different time lag than is present in input 10. The time scale ratio $\alpha$ is defined as $S_a/S_s$; $\alpha>1$ for compression and $\alpha<1$ for expansion. A weighting function, such as a linear cross-fade, illustrated in FIG. 1B, is used to combine overlapped windows. To overlap an input block 16 with an output block 18, samples in the overlapped regions of input block 16 are scaled by a linearly increasing function, while samples in output block 18 are scaled by a linearly decreasing function, to generate new output signal 20. Note that the SOLA method changes the overall rate of the signal without changing the rates of individual windows, thereby preserving pitch.

To maximize quality of the resulting signal 14, frames are not overlapped at a predefined separation distance. The actual offset is chosen, typically within a given range, to maximize a similarity measure between the two overlapped frames, ensuring optimal sound quality. For each potential overlap offset within a predefined search range, the similarity measure is calculated, and the chosen offset is the one with the highest value of the similarity measure. For example, a correlation function between the two frames may be computed by multiplying x(t) and y(t) at each offset. This technique produces a signal of high quality, i.e., one that sounds natural to a listener, and high intelligibility, i.e., one that can be understood easily by a listener. A variety of quality and intelligibility measures are known in the art, such as total harmonic distortion (THD).

The basic SOLA framework permits a variety of modifications in window size selection, similarity measure, computation methods, and search range for overlap offset. U.S. Pat. No. 5,479,564, issued to Vogten et al., discloses a method for selecting the window of the input signal based on a local pitch period. A speaker-dependent method known as WSOLA-SD is disclosed in U.S. Pat. No. 5,828,995, issued to Satyamurti et al. WSOLA-SD selects the frame size of the input signal based on the pitch period. A drawback of these and other pitch-dependent methods is that they can only be used with speech signals, and not with music. Furthermore, they require the additional steps of determining whether the signal is voiced or unvoiced, which can change for different portions of the signal, and for voiced signals, determining the pitch. The pitch of speech signals is often not constant, varying in multiples of a fundamental pitch period. Resulting pitch estimates require artificial smoothing to move continuously between such multiples, introducing artifacts into the final output signal.

Typically, the location within an existing output frame at which a new input frame is overlapped is selected, based on the calculated similarity measure. However, some SOLA methods use the similarity measure to select overlap locations of input blocks. U.S. Pat. No. 5,175,769, issued to Hejna, Jr. et al., discloses a method for selecting the location of input blocks within a predefined range. The method of Hejna, Jr. requires fewer computational steps than does the original SOLA method. However, it introduces the possibility of skipping completely over portions of the input signal, particularly at high compression ratios (i.e., $\alpha \geqq 2$). A speech rate modification method described in U.S. Pat. Nos. 5,341,432 and 5,630,013, both issued to Suzuki et al., determines the optimal overlap of two successive input frames that are then overlapped to produce an output signal. In the traditional SOLA method, in which input frames are successively overlapped onto output frames, each output frame can be a sum of all previously overlapped frames. With the method of Suzuki et al., however, input frames are overlapped only onto each other, preventing the overlap of multiple frames. In some cases, this limited overlap may decrease the quality of the resultant signal. Thus selecting the offset within the output signal is the most reliable method, particularly at high compression ratios.

Computational cost of the method varies with the input sampling rate and compression ratios. High sampling rates are desirable because they produce higher quality output signals. In addition, high compression ratios require high processing rates of input samples. For example, CD quality audio corresponds to a 44.1 kHz sampling rate; at a compression ratio of $\alpha=4$, approximately 176,000 input samples must be processed each second to generate CD quality output. In order to process signals at high input sampling rates and high compression ratios, computational efficiency of the method is essential. Calculating the similarity measure between overlapping input and output sample blocks is the most computationally demanding part of the algorithm. A correlation function, one potential similarity measure, is calculated by multiplying corresponding samples of input and output blocks for every possible offset of the two blocks. For an input frame containing N samples, $N^2$ multiplication operations are required. At high input sampling rates, for N on the order of 1000, performing $N^2$ operations for each input frame is unfeasible.

As a result, the trend in SOLA is to simplify the computation to reduce the number of operations performed. One solution is to use an absolute error metric, which requires only subtraction operations, rather than a correlation function, which requires multiplication. U.S. Pat. No. 4,864,620, issued to Bialick, discloses a method that uses an Average Magnitude Difference Function (AMDF) to select the optimal overlap. The AMDF averages the absolute value of the difference between the input and output samples for each possible offset, and selects the offset with the lowest value. U.S. Pat. No. 5,832,442, issued to Lin et al., discloses a method employing an equivalent mean absolute error in overlap. While absolute error methods are significantly less computationally demanding, they are not as reliable or as well accepted as correlation functions in locating optimal offsets. A level of accuracy is sacrificed for the sake of computational efficiency.

The overwhelming majority of existing SOLA methods reduce complexity by selecting a limited search range for determining optimal overlap offsets. For example, U.S. Pat. No. 5,806,023, issued to Satyamurti, discloses a method in which the optimal overlap is selected within a predefined search range. The Bialick patent mentioned above uses the input signal pitch period to determine the search range. In "An Edge Detection Method for Time Scale Modification of Acoustic Signals," by Rui Ren, an improved SOLA technique is introduced. Again, the method of Ren uses a small search window, in this case an order of magnitude smaller than the input frame, to locate the optimal offset. It also uses edge detection and is therefore specific to a type of signal, generating different overlaps for different types of signals.

A prior art method that limits the search range for optimal overlap offset is illustrated in the example of FIG. 2. The best position within an output block 24 y(t) to overlap an input block 22 x(t) is located. Output block y(t) has a length of $S_o$+H+L samples, and input block x(t) has a length of $S_o$ samples. In this case, the search range over which the similarity measure is computed is H+L samples; that is, the range of potential lag values is equal to the difference in length between the two sample blocks being compared. Three possible values of overlap lags are illustrated: −L, 0, and +H. In this method, the similarity measure 26 has a rectangular envelope shape over the range of lag values for which it is evaluated. This means that when averaged across all possible signals, the position of maximum value of the similarity measure has an equal or flat probability distribution within the range of lag values for which it is evaluated. This feature is not dependent on the type of similarity measure used, but is instead a result of comparing an equal number of samples from both segments for all potential lag values.

By limiting the search range, all of the prior art methods are likely to predict overlap offset incorrectly during quickly changing or complicated mixed signals. In addition, by predetermining a relatively narrow search range, these methods essentially fix the compression ratio to be very close to a known value. Thus they are incapable of processing input signals sampled at highly varying rates. In general, they are best for small overlaps of relatively long frames, which cannot produce high (i.e., $\alpha \geqq 2$) compression ratios.

There is a need, therefore, for an improved time scale modification method that is computationally feasible, highly accurate, and applicable to a wide range of audio signals.

OBJECTS AND ADVANTAGES

Accordingly, it is a primary object of the present invention to provide a time scale modification method for altering the playback rate of audio signals without changing their pitch.

It is a further object of the invention to provide a time scale modification method that can process speech, music, or combined speech and music signals.

It is an additional object of the invention to provide a time scale modification method that generates output at a constant, real-time rate from input samples at a variable, non-real-time rate.

It is another object of the present invention to provide a time scale modification method that provides a variable compression ratio, determined by the required output rate and variable input rate.

It is a further object of the invention to provide a time scale modification method that can overlap input and output frames over the entire range of the output frame, and not just over a specified narrow search range, while remaining computationally efficient. Successive frames may even be inserted behind previous frames, allowing for high quality output at high compression ratios.

It is an additional object of the invention to provide a time scale modification method that uses a correlation function to determine optimal offset of overlapped input and output frames. A correlation function is well known to be a maximum likelihood estimator, unlike absolute error metric methods.

Finally, it is an object of the present invention to provide a time scale modification method that does not require determination of pitch or other signal characteristics.

SUMMARY

These objects and advantages are attained by a method for time scale modification of a digital audio input signal, containing input samples, to form a digital audio output signal, containing output samples. The method has the following steps: selecting an input block of N/2 input samples; selecting an output block of N/2 output samples; determining an optimal offset T for overlapping the beginning of the input block with the beginning of the output block; and overlapping the blocks, offsetting the input block beginning from the output block beginning by T samples. T has a possible range of −N/2 to N/2, and is calculated by taking discrete frequency transforms of the N/2 input samples and the N/2 output samples, and then computing their correlation function. The maximum value of an inverse discrete frequency transform of the correlation function occurs for a value of offset t=T. The frequency transform is preferably a discrete Fourier transform, but it may be any other frequency transform such as a discrete cosine transform, a discrete sine transform, a discrete Hartley transform, or a discrete transform based on wavelet basis functions. Preferably, N/2 zeroes are appended to the input samples and to the output samples before the frequency transform is performed, to prevent wrap-around artifacts. Preferably, the correlation function is $Z(k)=X^*(k)\cdot Y(k)$, for $k=0, \ldots, N/2-1$, where $X^*(k)$ are the complex conjugates of the frequency transformed input samples, Y(k) are the frequency transformed output samples, and Z(k) are the products of their complex multiplication. Preferably, Z(k) is normalized before the inverse frequency transform is performed.

The output signal is preferably output at a constant, real-time rate, which determines the selection of the beginning of the output block. The input signal may be obtained at a variable rate. Preferably, the input block size and location are selected independently of a pitch period of the input signal. The input block and output block are overlapped by applying a weighting function, preferably a linear function.

The present invention also provides a method for time scale modification of a multi-channel digital audio input signal, such as a stereo signal, to form a multi-channel digital audio output signal. The method has the following steps: obtaining individual input channels, independently modifying each input channel, and combining the output channels to form the multi-channel digital audio output signal. The individual channels can be obtained either by separating a multi-channel input signal into individual input channels, or by generating multiple input channels from a single-channel input signal. Each input channel is independently modified according to the above method for time scale modification of a digital input signal. There is no correlation between overlapped blocks of the different audio channels; corresponding samples of input channels no longer correspond in the output signals. However, the listener is able to integrate perceptually the different channels to accommodate the lack of correspondence.

Also provided is a digital signal processor containing a processing unit configured to carry out method steps for implementing the time scale modification method described above.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiment of the invention is set forth without any loss of generality to, and without imposing limitations upon, the claimed invention.

The present invention provides a method for time scale modification of digital audio signals using an improved synchronized overlap-and-add (SOLA) technique. The method is computationally efficient; can be applied to all types of audio signals, including speech, music, and combined speech and music; and is able to process complex or rapidly changing signals under high compression ratios, conditions that are problematic for prior art methods. The method is particularly well suited for processing an input signal with a variable input rate to produce an output signal at a constant rate, thus providing continually varying compression ratios $\alpha$.

Figure 1A:
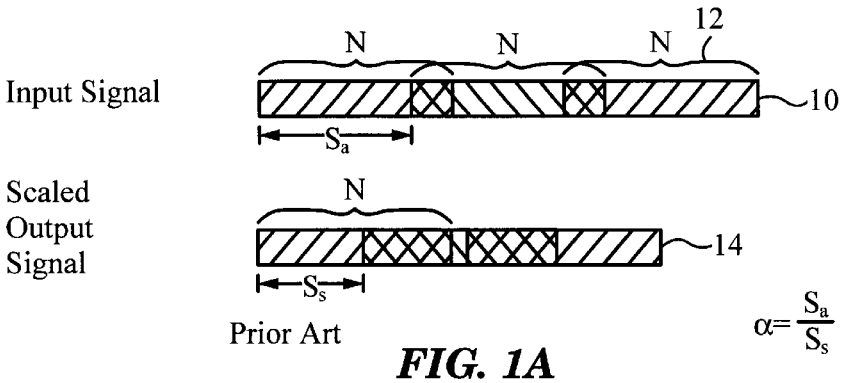
FIG. 1A illustrates the synchronized overlap-and-add (SOLA) method of the prior art.
Figure 1B:
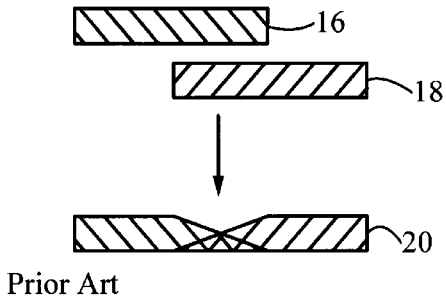
FIG. 1B illustrates a prior art linear cross-fade used to overlap two sample blocks.
Figure 3:
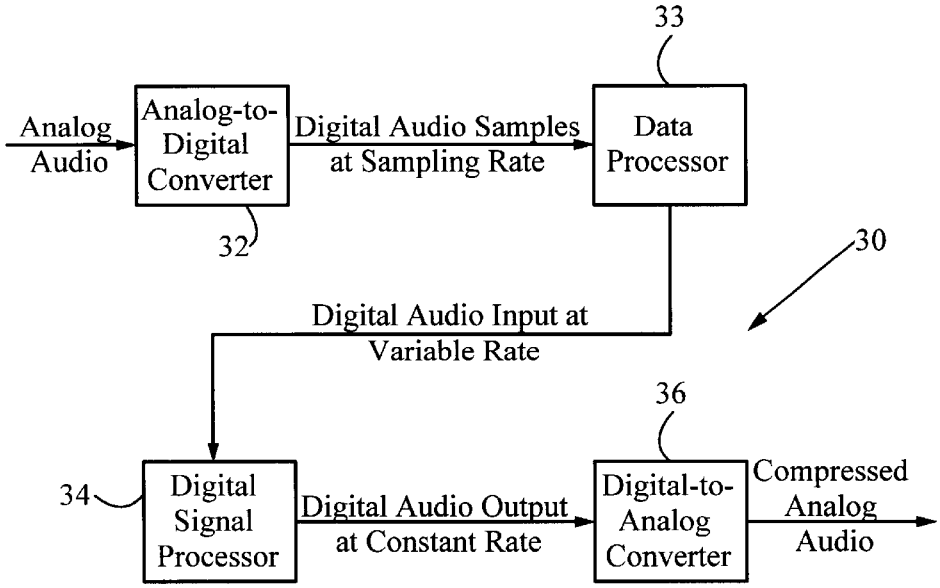
FIG. 3 is a schematic diagram of a system for implementing the method of the present invention.
Figure 2:
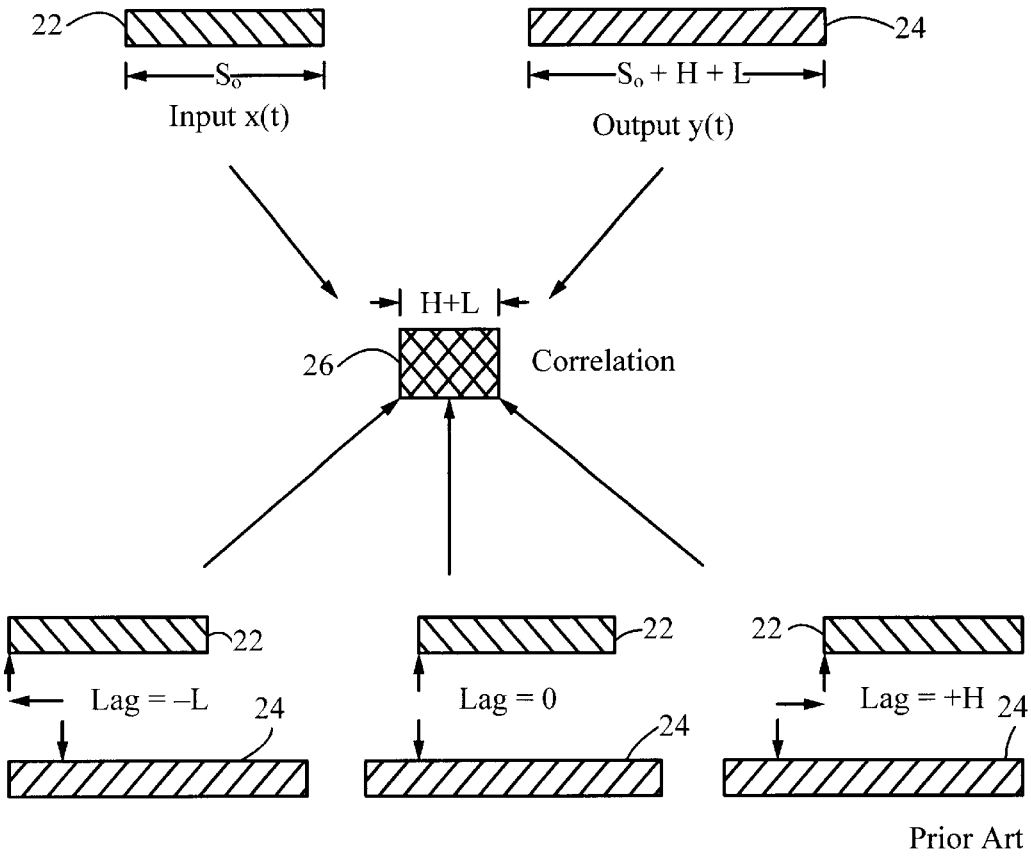
FIG. 2 illustrates a prior art correlation to find the optimal overlap lag for merging an output block with an input block.

A system 30 for implementing the present invention is illustrated in FIG. 3. The method of the invention is performed by a digital signal processor 34. Digital signal processor 34 is a conventional digital signal processor as known in the art, programmed to perform the method of the present invention. It contains a processing unit, random access memory (RAM), and a bus interface through which data is transferred. Digital signal processor 34 receives a digital audio signal originating from an analog-to-digital converter (ADC) 32, which samples an analog audio signal at discrete points in time to generate a digital audio signal. The present invention is capable of processing signals with a wide range of sampling rates. For example, typical signals that the present invention processes include telephone signals, with sampling rates of 8 kHz, and compact disc (CD) quality signals, with sampling rates of 44.1 kHz. Note that higher sampling rates produce higher quality audio signals. Samples are taken by ADC 32 at a sampling rate that is specified and that does not change. The rate may be set by the wall clock input to ADC 32, which is effectively constant. ADC 32 typically requires a low-jitter (i.e., constant rate) clock input. Digital audio signals may then be stored in memory, recorded, transmitted, or otherwise manipulated in data processor 33 before being input to digital signal processor 34 at a varying or unknown rate or a rate that is not at real time (i.e., changed from the original recording speed). The input rate refers to the number of samples per second arriving at digital signal processor 34, and is not related to the sampling rate, which is fixed. Digital signal processor 34 performs time scale compression of the input signal to generate a digital output signal that is at a predetermined, preferably constant and real-time rate. In time scale compression, a given amount of input data are output in a smaller time period. For example, at a compression ratio $\alpha=2$, an input signal that takes 4 minutes to play is reproduced in 2 minutes. Note that at $\alpha=4$, generating the compressed audio signal at CD quality, i.e., 44.1 kHz sampling rate, requires 176,400 input samples to be processed per second. Such high processing rates, while prohibitive for prior art methods, are easily attained with the present invention using existing 100 MIPS (million instructions per second) signal processors. The generated digital output signal is then sent to a digital-to-analog converter (DAC) 36 to produce an analog signal with the same pitch as the original signal, but reproduced in a shorter time period. DAC 36 preferably also requires a low-jitter clock input and therefore outputs the signal at a constant rate.

Figure 4:
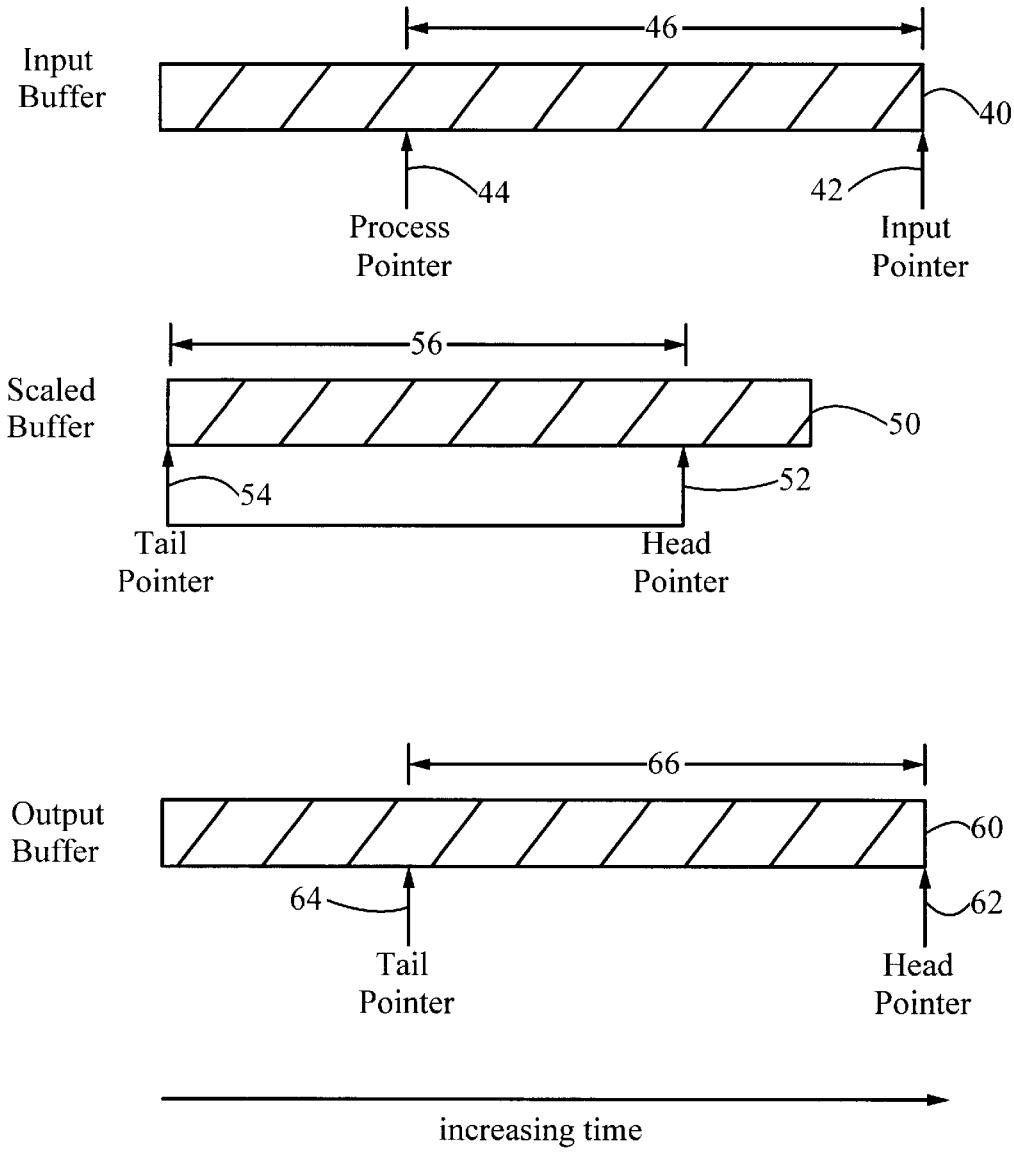
FIG. 4 illustrates the input buffer, scaled buffer, and output buffer of the present invention.

FIG. 4 illustrates three circular buffers of digital signal processor 34 that store input, output, and scaled audio signals. The buffers are illustrated as rectangles, but are intended to represent circular buffers. That is, the two ends of the rectangles wrap around to join each other. The horizontal distance along the buffers represents time. Distances in all buffers are measured in discrete time points at which samples are taken, equivalent to the number of samples. All three buffers may vary in length. Because the buffers are circular, pointers are used to indicate input, output, and processing points. In all three buffers, pointers move to the right as samples enter, exit, and are processed.

Movement of buffer pointers to the right, i.e., in the forward time direction, is referred to as advancing the pointers.

Before considering the full details of the method, it is useful to examine the contents of the buffers themselves. Input buffer 40 has two pointers, an input pointer 42 and a process pointer 44. New input audio samples are received, e.g., from ADC 32, and stored in input buffer 40. Samples are inserted after input pointer 42; that is, input pointer 42 is advanced when new samples are added. New input samples are added to input buffer 40 by an interrupt service routine. Process pointer 44 and input pointer 42 move independently of each other, causing a variation in the distance 46 between the two pointers. When new samples are added to input buffer 40, distance 46 increases. As samples are processed, distance 46 decreases.

Scaled buffer 50 stores samples that are being combined to form the scaled output signal. The scaled buffer head pointer 52 locates the output samples that are being overlapped with input samples. As explained further below, the search range for overlap lag is centered about scaled buffer head pointer 52. Tail pointer 54 indicates samples to be removed from scaled buffer 50. As tail pointer 54 advances over signals, they exit scaled buffer 50. Tail pointer 54 and head pointer 52 are separated by a fixed distance 56: when scaled buffer tail pointer 54 is advanced, scaled buffer head pointer 52 is advanced by an equal amount.

Samples removed from scaled buffer 50 are copied to output buffer 60 at output buffer head pointer 62, which advances to remain to the right of all newly copied samples. Samples to the left of output buffer tail pointer 64 are output, e.g., to DAC 36, by an interrupt service routine. Movement of output buffer tail pointer 64 is determined by the chosen output rate. As tail pointer 64 advances continually over signals, they exit output buffer 60. In contrast, head pointer 62 is periodically advanced by an amount equal to the number of samples advanced by tail pointer 64 since head pointer 62 was last advanced. As a result, immediately after head pointer 62 is advanced, tail pointer 64 and head pointer 62 are separated by a predetermined distance 66. In between advances of head pointer 62, however, distance 66 decreases. Movement of output buffer tail pointer 64 therefore controls the periodic advance of output buffer head pointer 62, scaled buffer tail pointer 54, and scaled buffer head pointer 52.

In an alternative embodiment, output samples are removed directly from scaled buffer 50. In this case, distance 56 is not fixed, and tail pointer 54 advances continually. Head pointer 52 advances only periodically, by a distance equal to the number of samples advanced by tail pointer 54 since head pointer 52 was last advanced. This alternative embodiment is preferred when no further processing of the signal is required. In the case described above, in which all three buffers are used, further processing may be performed on the scaled buffer samples after time scale modification is performed. The samples that have been further processed are copied into output buffer 60 before being output.

An object of the method of the present invention is to compress the samples in input buffer 40 to generate the compressed signal of output buffer 60. Compression is performed by overlapping input samples with output samples at locations that lead to the highest possible signal quality, while being constrained to the desired output rate.

Figure 5:
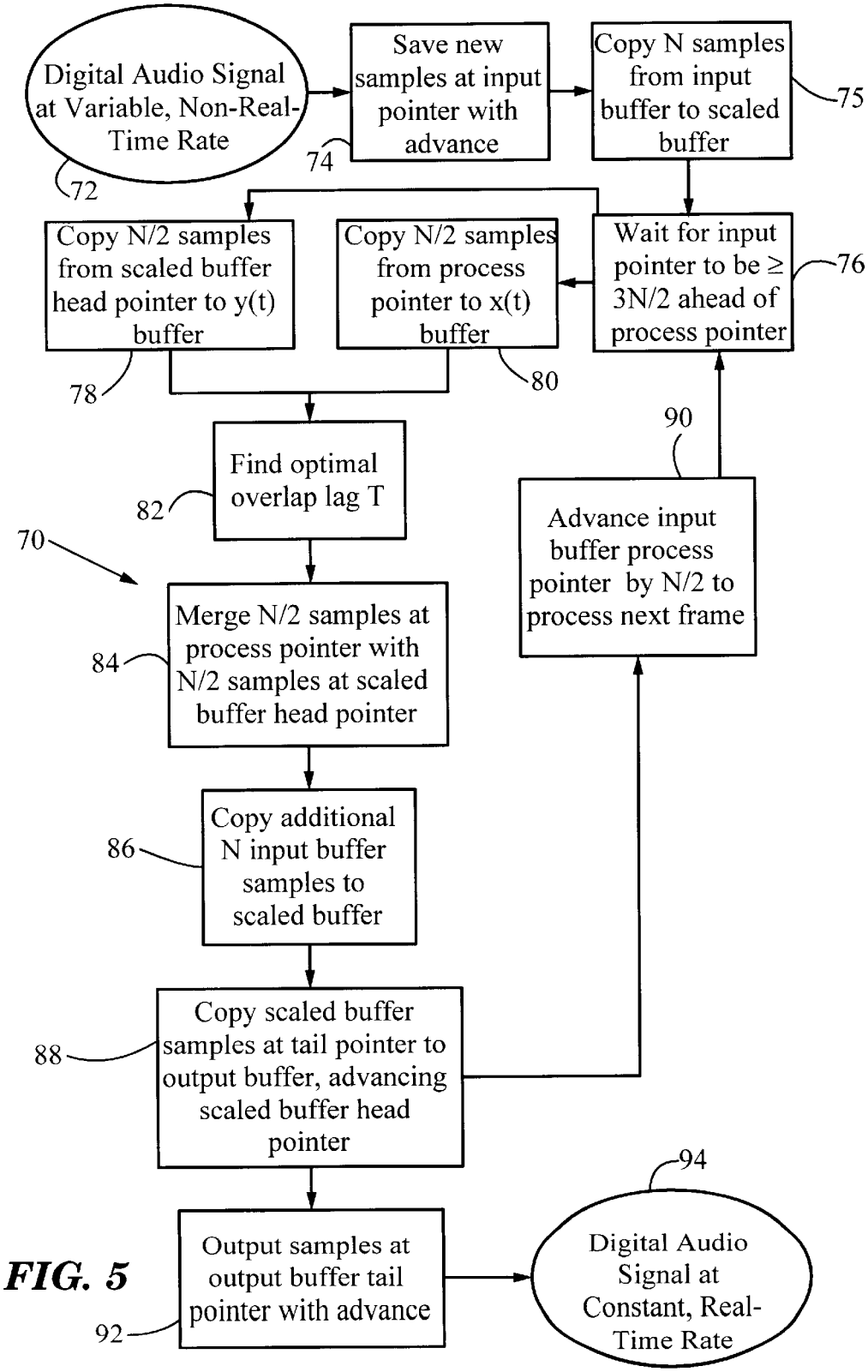
FIG. 5 is a block diagram of the time scale modification method of the present invention.

FIG. 5 is a block diagram of the overall method 70 of the present invention for time compression of a digital audio signal. Method 70 transforms a digital audio signal 72, input at a rate that may be variable and non-real-time, into a digital output signal 94 that is at a constant, real-time rate. FIGS. 6A–6D illustrate relevant buffer positions and changes corresponding to method 70. Buffers of FIGS. 6A–6D are shown with frames or blocks of length N/2 samples. Of course, such distinctions are arbitrary, and do not correspond to pitch period or any characteristic of the signal.

Figure 6A:
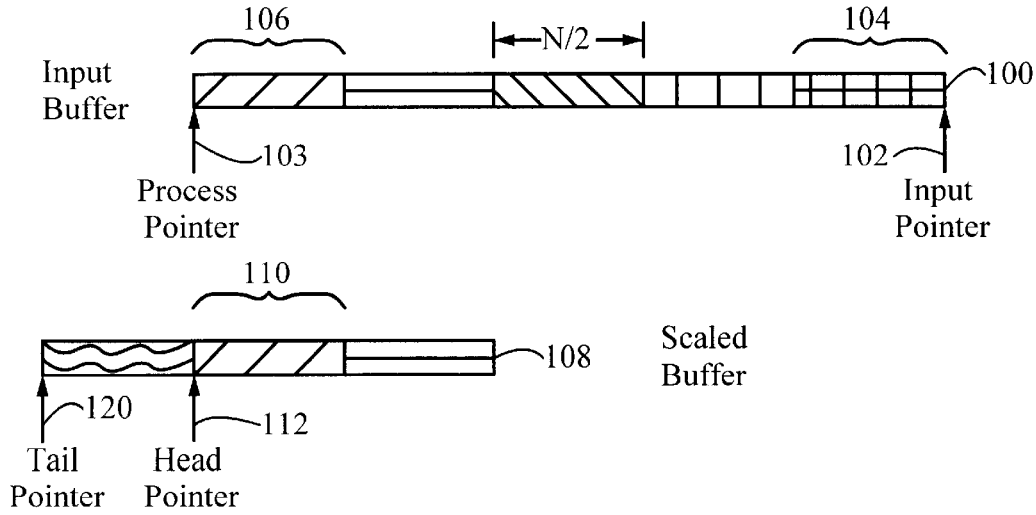
FIGS. 6A–6D illustrate one iteration of the time scale modification method of FIG. 5.
Figure 6C:
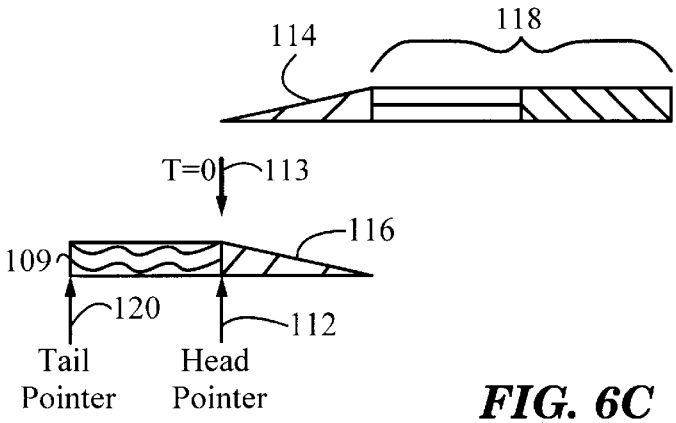
Figure 6B:
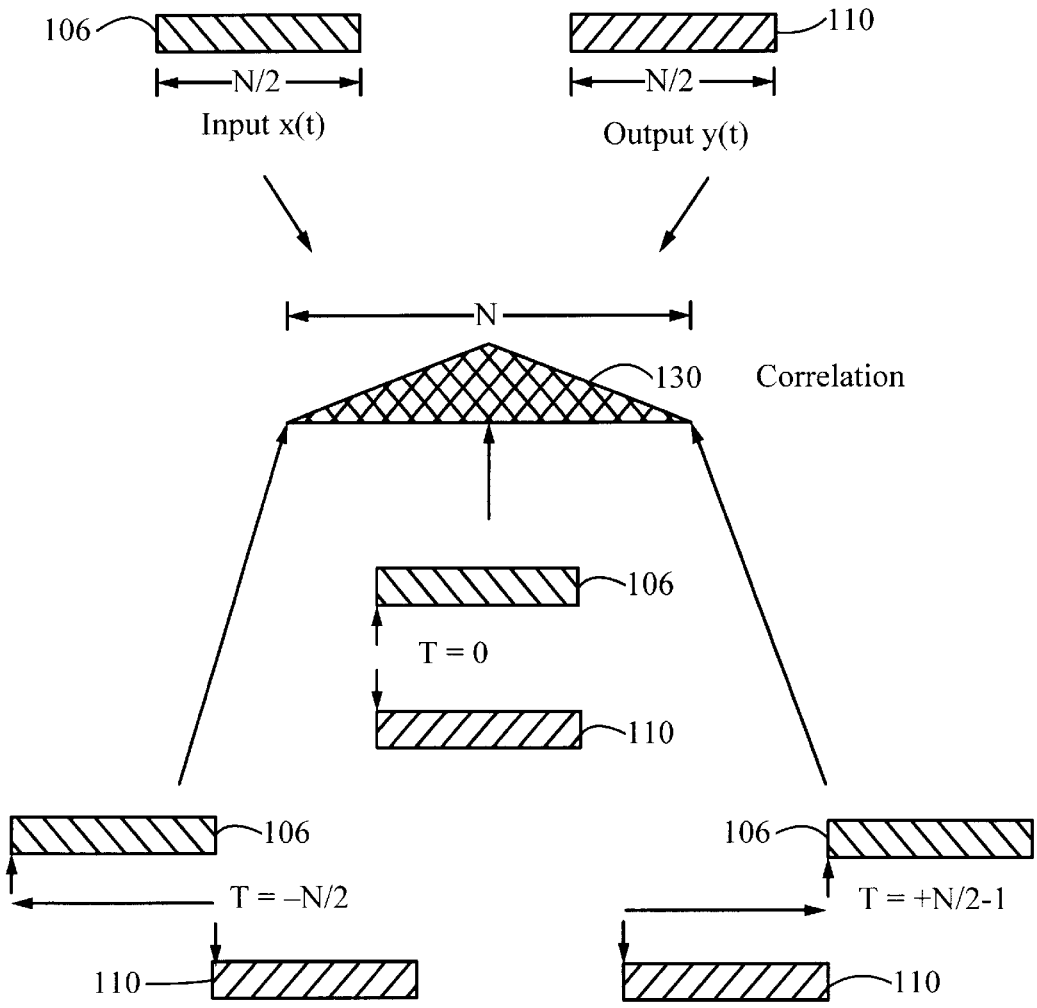

The method is best understood by considering FIGS. 5 and 6A–6D concurrently. In a first step 74, input samples are saved into an input buffer 100 at its input pointer 102, which is then advanced. For example, block 104, which contains N/2 samples, has been most recently saved into input buffer 100. Next, in step 75, N samples ahead of process pointer 103 are copied from input buffer 100 to scaled buffer 108 at the scaled buffer head pointer 112, without advancing the process pointer 103. These first steps are required to initialize the buffers and method; FIG. 6A illustrates the buffer after processing iterations have already occurred. In step 76, the method waits for the input pointer 102 to be at least 3N/2 samples ahead of the process pointer 103. In FIG. 6A, input pointer 102 is 5N/2 samples ahead of process pointer 103. When this condition is satisfied, in step 78, the N/2 samples ahead of process pointer 103, labeled 106, are copied into an x(t) buffer. Similarly, in step 80, the N/2 samples (labeled 110) ahead of the head pointer 112 of scaled buffer 108 are copied into a y(t) buffer. The x(t) and y(t) buffers are illustrated in FIG. 6B. The optimal overlap lag T between the beginning of the x(t) samples 106 and the beginning of the y(t) samples 110 is found in step 82 using a discrete frequency transform based correlation function, such as a discrete Fourier transform based correlation function, as described in detail below. T has a possible range of −N/2 to +N/2−1; three possible lags are illustrated in FIG. 6B. At a lag of T=−N/2, samples 106 are overlapped behind samples 110. At a lag of T=0, samples 106 are overlapped directly on top of samples 110. At a lag of +N/2−1, samples 106 are overlapped ahead of samples 110. Note that all intermediate integer values of lag T are possible.

Figure 6D:
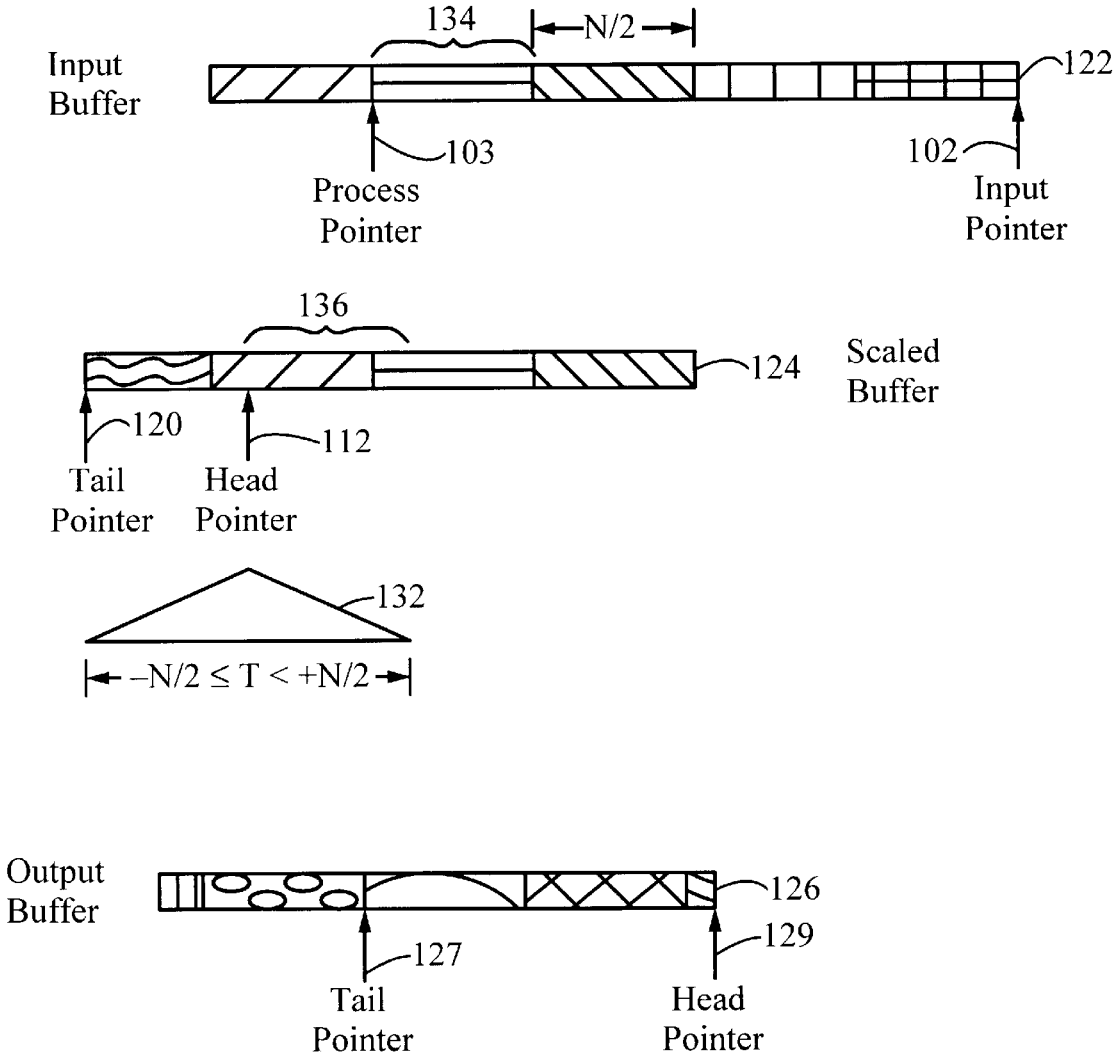

As shown in FIG. 6C, the optimal overlap for this example is T=0, indicated by the large arrow labeled 113, with T measured from the location of the scaled buffer head pointer 112. That is, samples 106 are overlapped directly on top of samples 110, beginning at the location of the scaled buffer head pointer 112. The two sample blocks 106 and 110 are merged in step 84, using a linear cross fade to obtain weighted samples 114 and 116 that are summed. Immediately following the merged samples, N additional input buffer samples 118 are copied to modified scaled buffer 109, in step 86. When these additional samples 118 are copied, samples that were originally in the scaled buffer are overwritten. The resulting scaled buffer 124 is shown in FIG. 6D.

The scaled buffer tail pointer 120, scaled buffer head pointer 112, and output buffer head pointer 129 (FIG. 6D) are advanced, and samples behind scaled buffer tail pointer 120 are copied to the output buffer in step 88. The input buffer process pointer 103 is advanced by N/2 samples in step 90, and the method returns to step 76. In step 92, which occurs continually and not just at the end of a processing iteration, samples at the output buffer tail pointer 127 are output, with advance to the output buffer tail pointer 127, to produce the digital audio signal 94 at a constant real-time rate. This advance determines the amount that the output buffer head pointer 129, scaled buffer tail pointer 120, and scaled buffer head pointer 112 are advanced in step 88. The three pointers are advanced by the amount that output buffer tail pointer 127 has been advanced since the beginning of the processing iteration. The chosen output rate, which controls the advance of output buffer tail pointer 127, therefore effectively determines the beginning of the samples y(t) and the location of the search range in the scaled buffer for the subsequent iteration, through the advance of the scaled buffer head pointer 112. The resulting input buffer 122, scaled buffer 124, and output buffer 126 are illustrated in FIG. 6D. Note that for this particular processing iteration, the output signal has not been compressed.

Referring again to FIG. 6B, it is noted that the particular characteristics of the correlation function used result in evaluation of a similarity measure between x(t) and y(t) for a range of N different offset or lag values T. The optimal offset value is chosen from these N potential values. That is, the range of possible lags is equal to the sum of the lengths of the two input blocks 106 and 110. Note that this is distinct from prior art methods that have an offset search range equal to the difference between the lengths of the two input blocks.

An additional characteristic following from the correlation function used in the present method is a triangular envelope 130 of the similarity measure over the range of potential lag values. Again, this is in direct contrast with the prior art methods that have a rectangular shape to the similarity measure. In the present invention, when averaged across all possible signals, the position of maximum value of the similarity measure has a probability distribution with a central maximum and tails descending to zero at either end of the range of lag values. This triangular shape has important advantages, particularly at higher time compression ratios. As a result of this shape, successive iterations of input frames can have large offsets that overlap each other, While still having distinct central maximums. In prior art methods with rectangular overlaps, successive iterations cannot have such large and highly overlapping offsets while maintaining distinct centers. As a result, prior art methods may not perform as well at high compression ratios as they do at lower ratios.

Figure 7A:
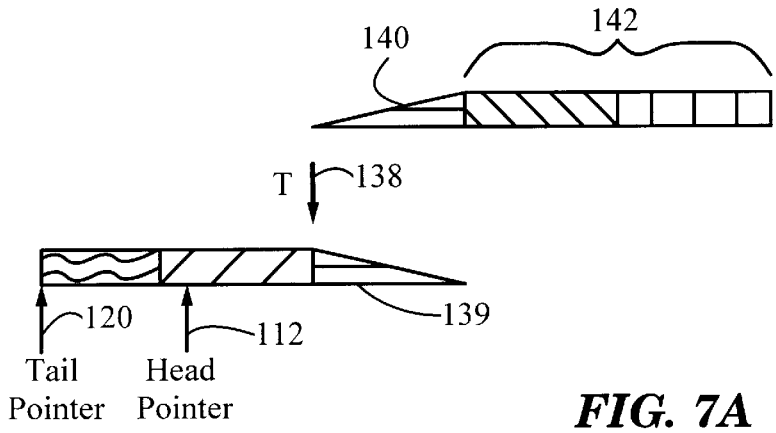
FIGS. 7A–7C illustrate a subsequent iteration of the time scale modification method of FIG. 5.
Figure 7B:
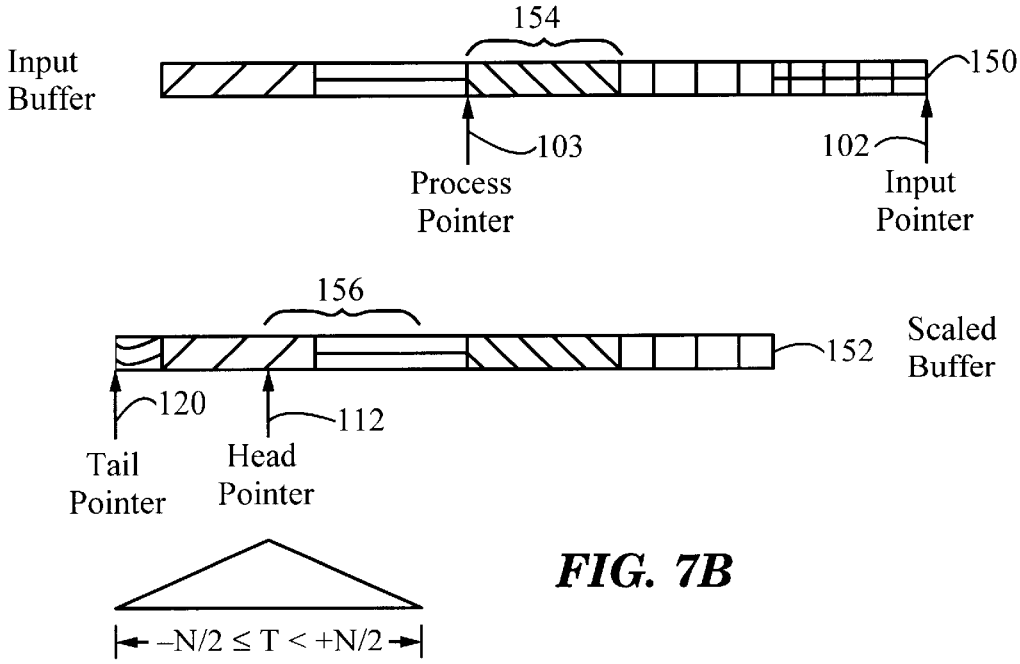
Figure 7C:
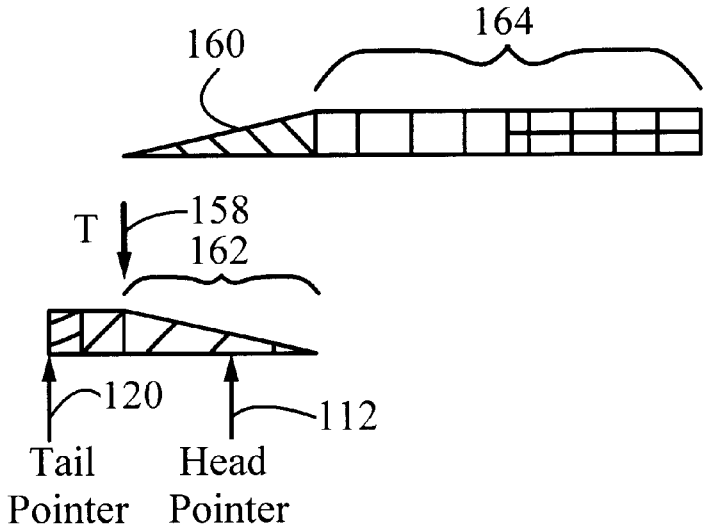

This ability of the present invention to overlap successive iterations is illustrated in FIGS. 7A–7C, which show subsequent iterations performed after the overlap of FIG. 6D. The N/2 samples (labeled 134) following process pointer 103 are copied to the x(t) buffer. The N/2 samples (labeled 136) following scaled buffer head pointer 112 are copied to the y(t) buffer. From the potential range of lag values illustrated by triangle 132, an optimal value is found, illustrated by the location of arrow 138 in FIG. 7A. Arrow 138 shows the location of the scaled buffer head pointer 112 plus the offset T. The N/2 scaled buffer samples following arrow 138 are weighted to form samples 139 which are merged with weighted N/2 input samples 140 as shown in FIG. 7A. Directly following the merged samples, an additional N samples 142 are copied to the scaled buffer.

Following advance of the scaled buffer tail 120 and head 112 pointers and the process pointer 103, the resultant input buffer 150 and scaled buffer 152 are as illustrated in FIG. 7B. The optimal overlap lag of samples 154 and 156 is next determined. In this case, as illustrated in FIG. 7C, T has a negative value, so that input samples 154 are merged behind scaled buffer head pointer 112. At arrow 158, the head pointer plus offset T, the weighted N/2 input samples 160 are overlapped with weighted scaled buffer samples 162 using a linear cross-fade. An additional N samples 164 are then copied into the scaled buffer. Comparing FIG. 7C with FIG. 6A reveals the high compression of the original input signal in buffer 100 to form the final scaled buffer, which will eventually be output. The iteration of the method illustrated in FIG. 7C also shows how subsequent iterations can overlap previous offset lags. FIG. 7C also illustrates that the distance between the scaled buffer head pointer and the scaled buffer tail pointer must be at least N/2, so that the samples that are removed from the scaled buffer have been completely processed.

Figure 8:
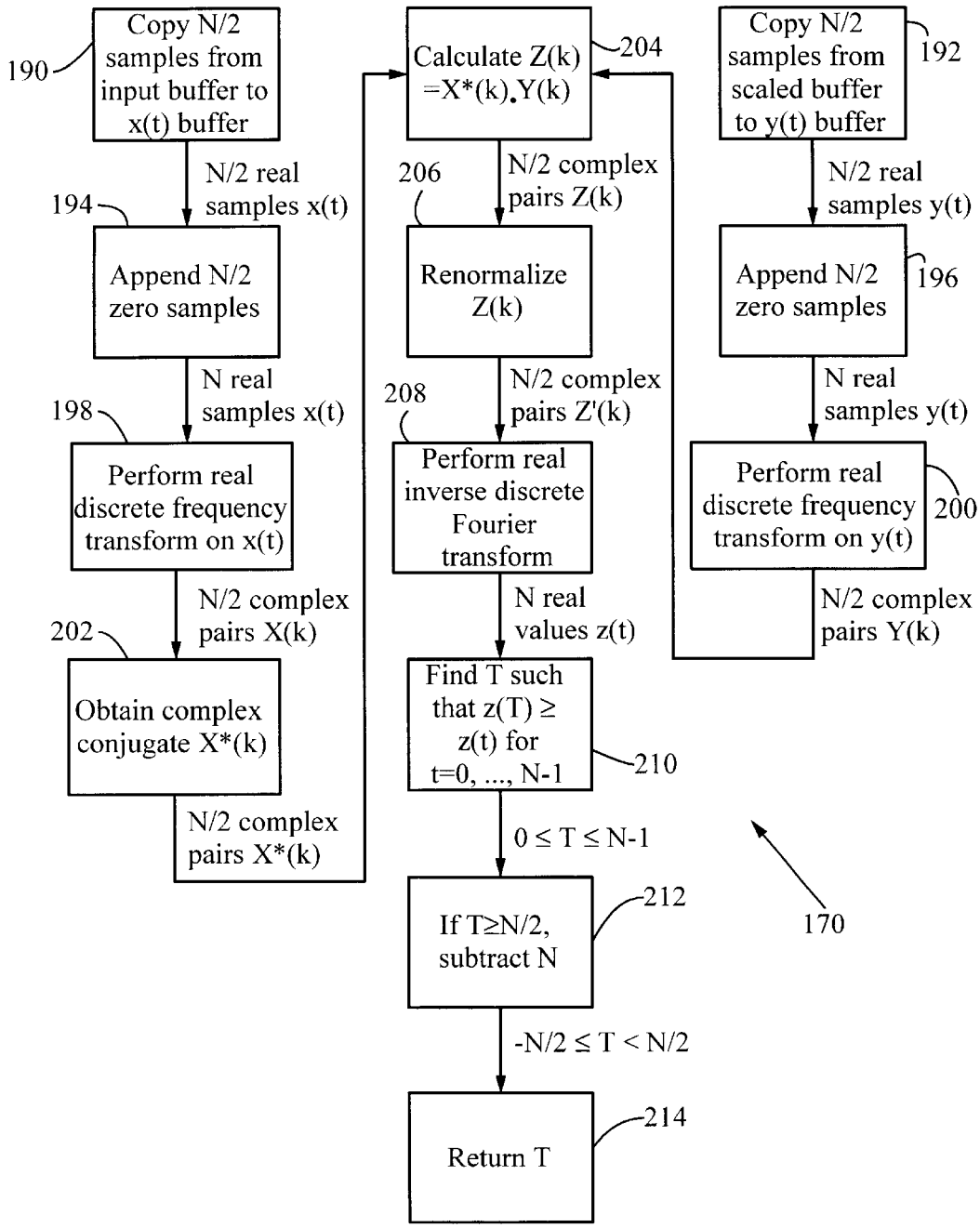
FIG. 8 is a block diagram of the method of the present invention for calculating the optimal overlap lag T.

The present invention enjoys many of its advantages as a result of its particular method for calculating the optimal overlap lag or offset T between input samples x(t) and output samples y(t). FIG. 8 is a block diagram of the method 170. In the present invention, computing T is accomplished by computing a correlation function between the two sample blocks at N possible offset values, and then determining the value of T that produces the highest correlation function. The range of possible lag values is equal to the sum of the lengths of the two sample blocks, unlike prior art methods that have much smaller possible ranges.

Method 170 begins with steps 190 and 192. In step 190, N/2 samples are copied from the input buffer, directly following the process pointer, to the x(t) buffer, for t=0, . . . , N/2−1. In step 192, N/2 samples are copied from the scaled buffer, directly following the scaled buffer head pointer, to the y(t) buffer, for t=0, . . . , N/2−1. In steps 194 and 196, N/2 zero samples are appended to both the x(t) and y(t) sample blocks to produce sample blocks containing N samples. In steps 198 and 200, discrete frequency transforms, such as Fourier transforms, are performed on N-sample blocks x(t) and y(t) to obtain N/2 frequency-domain complex pairs X(k) and Y(k), for k=0, . . . , N/2−1. The complex conjugates X*(k) of X(k) are obtained in step 202, and, in step 204, complex multiplication between X*(k) and Y(k) is performed to obtain N/2 complex pairs of the correlation function Z(k). Z(k) is optionally renormalized in step 206 by finding the maximum absolute magnitude of Z(k) real and imaginary components, and then scaling Z(k) by a factor equal to a nominal maximum divided by the actual maximum, to obtain Z'(k). The nominal maximum is a predetermined number, for example, a fraction of an allowed range for the variable type. Real inverse discrete frequency transforms are performed on Z'(k) in step 208 to obtain N real values of the correlation function z(t), for t=0, . . . , N−1. In step 210, the optimal offset T is chosen such that $z(T) \geqq z(t)$ for all t=0, . . . , N−1. If $T \geqq N/2$, then N is subtracted from the value of T in step 212, so that final values of T range from −N/2 to +N/2−1. Finally, in step 214, the value of T is returned.

The method of the present invention may be used with any value of N, which typically varies with the sampling rate. At high sampling rates, more samples must be processed in a given time period, requiring a higher value of N. For example, to generate CD quality audio, with 44.1 kHz sampling rates, a suitable value of N is 1024. Preferably, values of N are powers of 2, which are most efficient for the frequency transform algorithm. However, other values of N can be processed.

Preferably, the present invention uses a discrete Fourier transform and an inverse discrete Fourier transform to compute and evaluate the correlation function. However, any other discrete frequency transforms and corresponding inverse discrete frequency transforms known in the art are within the scope of the present invention. For example, suitable transforms include: a discrete cosine transform (DCT), a discrete sine transform (DST), a discrete Hartley transform (DHT), and a transform based on wavelet basis functions. All of these transforms have inverse discrete transforms, which are also required by the present invention.

Method 170 is equivalent to computing a correlation function between two set of samples, each of which contains N samples, as described in Press et al., *Numerical Recipes*

*in C,* Cambridge University Press, 1992, pages 545–546. To compute the function without using the Fourier transform, the sum $$\sum_{i=0}^{N-1}[x(t_i)y(t_i)]$$

would need to be computed at each possible time lag, an $O(N^2)$ operation. With presently available signal processors, performing $N^2$ operations for each processed frame is prohibitively costly, particularly at high sampling rates. Preferably, the Fourier transforms of steps 198 and 200 are calculated using a fast Fourier transform (FFT) algorithm, details of which may be found in Press et al., *Numerical Recipes in C,* Cambridge University Press, 1992. Performing a FFT on N samples requires N $\log_2$ N computations, which is feasible with current digital signal processors, even at high sampling rates. For example, for N=1024, $N^2$=1,048,576, but N $\log_2$ N=10,240. The FFT algorithm therefore allows the full lag range to be searched efficiently.

In contrast with the correlation function used by the present invention, which requires a multiplication operation, much of the prior art uses an absolute error metric. An absolute error metric measures the absolute value of the difference between samples, with the optimal lag occurring at the smallest value of the error metric. In contrast, a correlation function is a least squares error metric: the computed solution differs from a perfect result by an error that is effectively a least squares error. It is well known that a least squares error metric is a maximum likelihood estimator, in that it provides the best fit of normal (i.e., Gaussian) distributed data, while an absolute error metric is less well qualified as a mathematically optimal method.

Steps 194 and 196 of method 170, appending zero samples to the N/2 samples, is also crucial to the present invention's ability to search a lag range equal to the sum of the two sample blocks to be merged. The correlation function inherently assumes that the two samples are periodic in nature, i.e., that after the final sample of the x(t) buffer, the next sample is identical to the first sample of the x(t) buffer. In general, this is not the case, and such an assumption causes drastic errors in the correlation function computation and in determining the optimal value of lag T. Zeroes are appended to the N/2 samples to prevent the so-called wrap-around problem from occurring. The correlation function stores negative lag values after all positive lag values, and negative lag values are obtained by subtracting N from values of T greater than or equal to N/2.

Note that in step 202, the complex conjugate of only the input samples X(k) is taken. This results in the computed lag being equal to the lag of the input samples x(t) from the scaled buffer samples y(t).

Optional step 206 is used primarily for fixed point systems (i.e., integers), and not for systems that store floating point numbers. Since the absolute value of the correlation function is not important, but only the relative values, it is advantageous to scale the values of Z(k) to maximize accuracy and prevent overflow. For example, in a 16-bit integer system, possible values of the data type of the correlation function range from −32,768 to +32,767. Very low values of the correlation function decrease precision, while very high values risk overflow. A suitable nominal maximum can be chosen, such as, in this case, 8,191, one quarter of the maximum range, and all values scaled to this nominal maximum.

Figure 9:
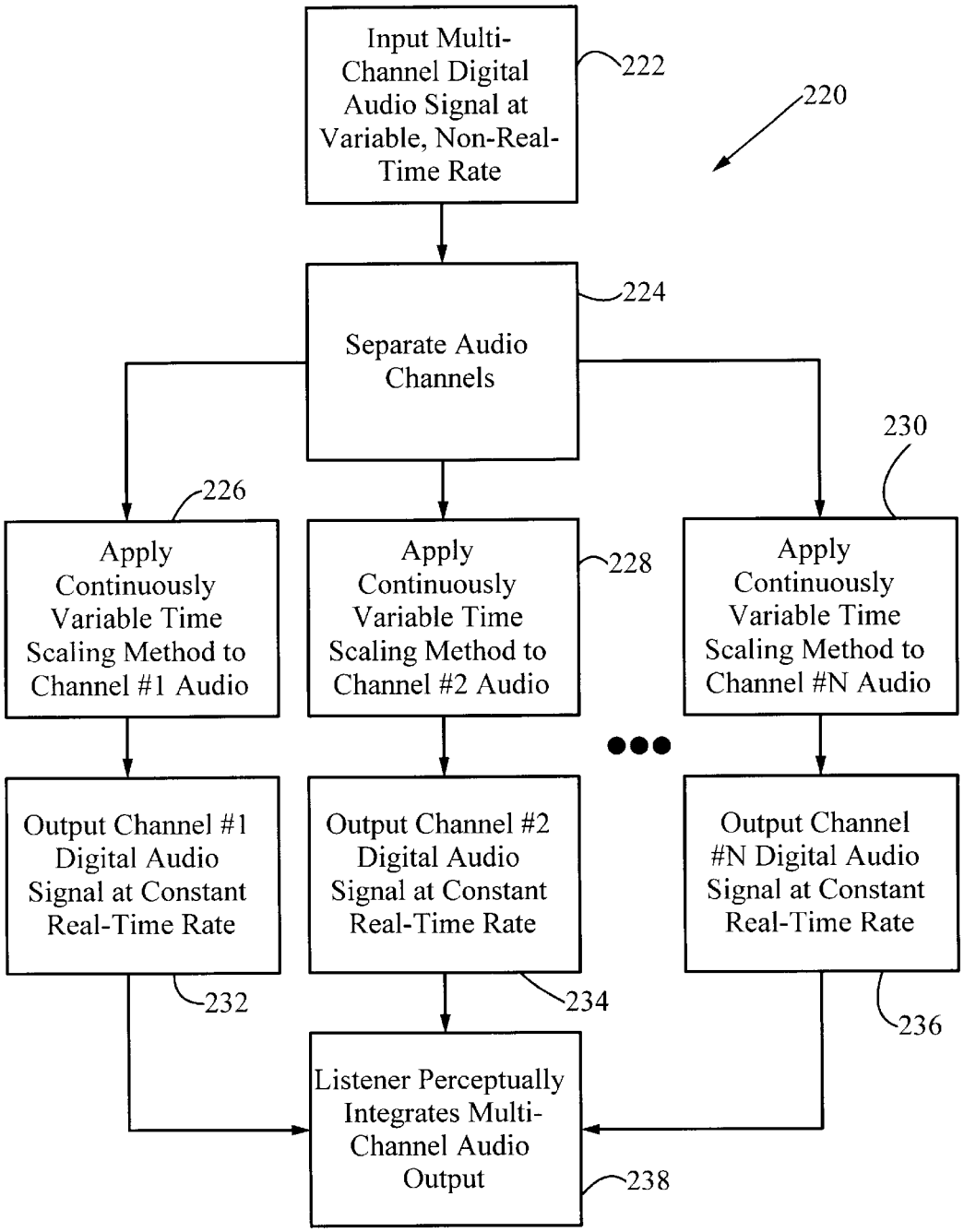
FIG. 9 is a block diagram of the method of the present invention for time scale modification of multi-channel audio signals.

FIG. 9 illustrates a method 220 for time scale modification of a multi-channel digital audio signal. Any number of audio channels may be processed, including the two channels of a stereo signal, four channels of a quadraphonic signal, and five channels of a surround-sound signal. The channels may also be correlated with a video signal. Method 220 incorporates the method for processing single-channel audio, processing each channel independently. In step 222, a multi-channel audio signal is input, possibly at a variable, non-real-time rate. In step 224, the audio channels are separated so that each may be processed individually. In steps 226, 228, and 230, each channel is processed independently according to method 70 of FIG. 5. Because the channels are processed independently, corresponding input blocks of different channels are not overlapped with their respective output blocks at the same overlap lag T. Rather, each channel's overlap lag is chosen considering only the correlation function of that particular channel.

In steps 232, 234, and 236, the resulting time scaled digital audio channels are output at constant, real-time rates. Note that corresponding samples of different channels no longer correspond, and may be played at different times. While this might appear to reduce the quality of the multi-channel output signal, evidence, in fact, shows just the opposite. Multi-channel audio processed according to method 220 appears to a listener, in step 238, to be of higher quality than multi-channel audio signals that are not processed independently. It is believed that the listener is able to integrate the different channels to effectively "make up" the samples that are missing from one channel but appear in another channel. This is consistent with the way a listener perceives sound originating from a moving source. If the spatial resolution of the sound is detectable by the listener, the listener is able to properly integrate the sound and account for any time delays, as if it originated from a moving source. In fact, humans (and other animals) are conditioned to listen for the movement of the sound source.

Figure 10:
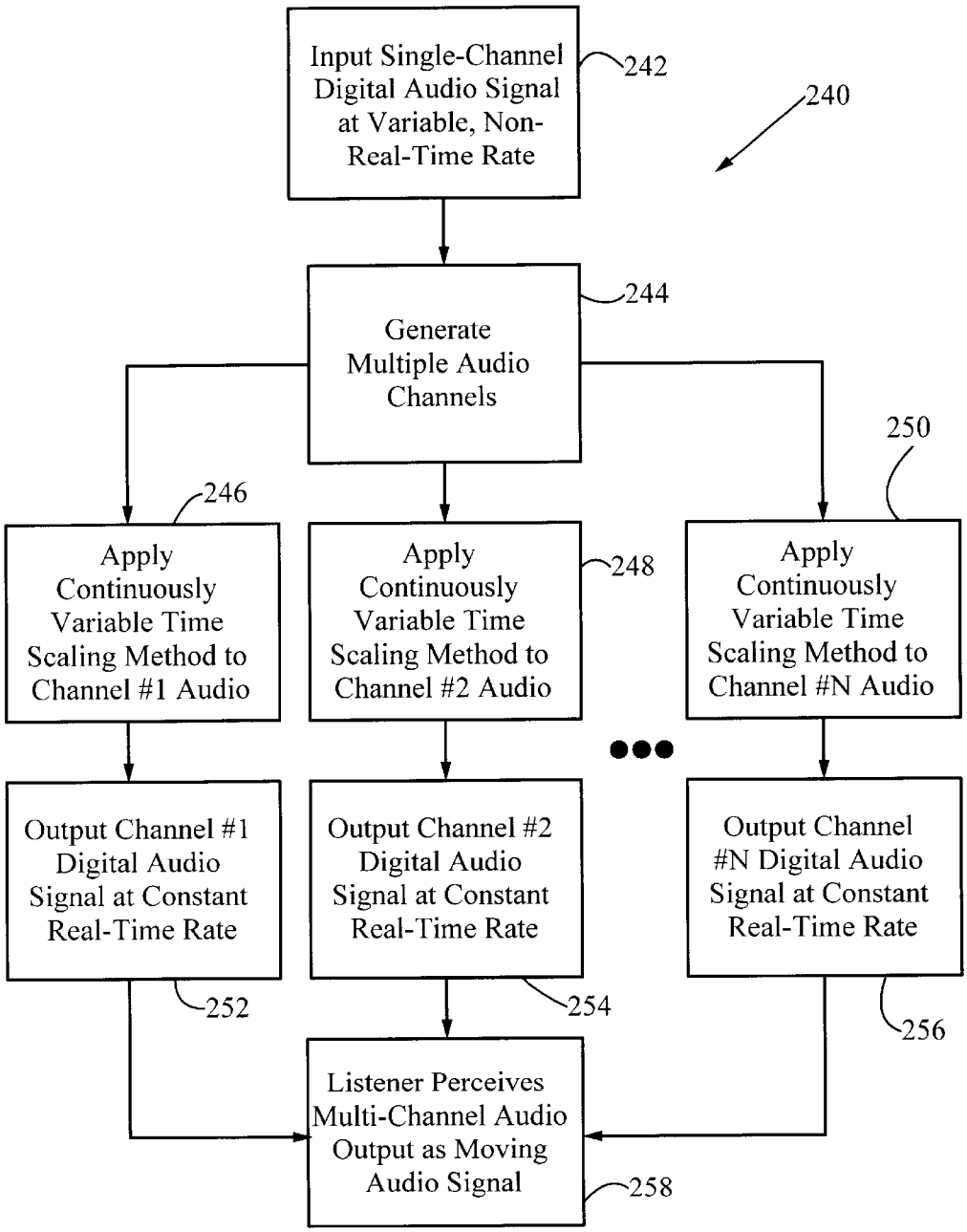
FIG. 10 is a block diagram of the method of the present invention for time scale modification of a single-channel audio signal by generating multiple channels.

This latter principle is taken advantage of in an alternative embodiment of the present invention, in which a signal is divided into multiple channels before being processed. The method 240 is illustrated in the block diagram of FIG. 10. In step 242, a single-channel digital audio signal is input at a rate that may be variable and non-real-time. The audio signal is divided into multiple channels in step 244 using any suitable method; a preferred method is discussed below. The multiple channels may be offset from each other by small time lags. The signal is divided into at least two, and possibly more, channels. In steps 246 and 248 through 250, the continually variable time scaling method of the present invention is applied independently to each channel. As with method 220 of FIG. 9, the overlap offset T's computed for individual channels in method 240 are not related. The individual channels are output in steps 252 and 254 through 256, preferably at a constant, real-time rate. Finally, in step 258, the listener integrates the independent channels, perceiving them as originating from a moving source.

In method 240, the time compressed output channels are integrated by the listener using the moving sound principle. Because the channels are processed independently, their frames are merged with different time lags; the listener perceives this as a sound source that moves spatially from channel to channel. The different time delay offsets for each channel may correspond to different input frame sequences for each channel and cause each channel to process different phases of the input signal. The different time delay offsets should preferably be in the range in which different channels are perceived as being spatially distinct, (i.e., on the left or right side of the listener), while not being so large that an echo effect dominates. For example, a frame size of N=1024 causes a frame advance of N/2=512 samples. A channel offset of half of this frame advance is equal to 256 samples. At a sample rate of 44,100 samples, this offset corresponds to a 5.8-millisecond time delay offset between input channels. This time delay offset has been found to be an effective channel separation for increased intelligibility at time compression ratios of up to 4.0 (in a dual channel configuration). Particularly in the case of fast speech, which may be difficult to understand when time compressed, two independently processed channels are more intelligible to the listener than a single channel. The perception of movement between channels aids in understanding the output.

Figure 11:
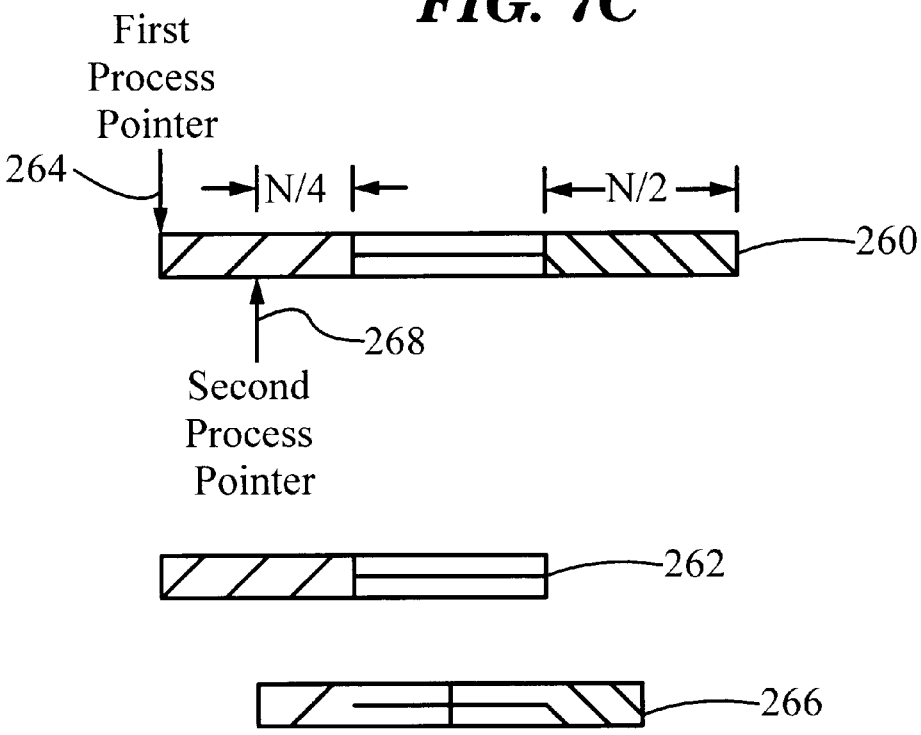
FIG. 11 illustrates one method for generating multiple channels from a single channel.

One method of generating multiple channels from a single channel is illustrated in FIG. 11. A single input buffer 260 contains multiple process pointers. Samples ahead of each process pointer are copied to distinct buffers, thereby leading to distinct output channels. In the case of FIG. 11, two process pointers, leading to two separate output channels, are shown. Any desired number of process pointers may be used. The process pointers are separated by a predetermined time lag that represents the spatial separation of two output channels (i.e., two microphones). Because the method processes N/2 samples in each iteration (in this particular example), the time lag between two channels is N/4. Analogously, three process pointers would be separated by ⅓of N/2 samples, i.e., N/6 samples. A first scaled buffer 262 is used to process the first channel corresponding to a first input buffer process pointer 264. A second scaled buffer 266 is used to process the second channel corresponding to a second input buffer process pointer 268. The resulting output samples are output with the fixed time lag N/2, so that the user perceives the samples as originating from spatially separated point sources.

It will be clear to one skilled in the art that the above embodiments may be altered in many ways without departing from the scope of the invention. Accordingly, the scope of the invention should be determined by the following claims and their legal equivalents.

What is claimed is:

1. A method for time scale modification of a digital audio input signal comprising input samples to form a digital audio output signal comprising output samples, said method comprising the steps of:

a) selecting an input block of N/2 input samples;

b) selecting an output block of N/2 output samples;

c) determining an optimal offset T for an overlap of a beginning of said input block with a beginning of said output block, wherein $-N/2 \leqq T < N/2$, wherein said offset determining comprises calculating a correlation function between discrete frequency transforms of said N/2 input samples and discrete frequency transforms of said N/2 output samples, wherein a maximum value of an inverse discrete frequency transform of said correlation function occurs for said optimal offset T; and d) overlapping said input block with said output block to form said output signal, wherein said input block beginning is offset from said output block beginning by T samples.

2. The method of claim 1 wherein said offset determining step further comprises appending N/2 zero samples to said N/2 input samples before performing said input frequency transforms, and appending N/2 zero samples to said N/2 output samples before performing said output frequency transforms.

3. The method of claim 1 wherein said discrete frequency transforms are discrete Fourier transforms, and wherein said inverse discrete frequency transform is an inverse discrete Fourier transform.

4. The method of claim 3 wherein said offset determining step comprises:

i) performing a discrete Fourier transform of said input samples to obtain X(k), for k=0, . . . , N/2−1;

ii) performing a discrete Fourier transform of said output samples to obtain Y(k), for k=0, . . . , N/2−1;

iii) performing a complex conjugation of X(k) to obtain X*(k), for k=0, . . . , N2−1;

iv) calculating a complex multiplication product $Z(k)=X^*(k)\cdot Y(k)$, for k=0, . . . , N/2−1;

v) performing an inverse discrete Fourier transform of Z(k) to obtain z(t); and vi) determining T for which z(T) is a maximum.

5. The method of claim 1 wherein said discrete frequency transforms are selected from the group consisting of discrete cosine transforms, discrete sine transforms, discrete Hartley transforms, and discrete transforms based on wavelet basis functions.

6. The method of claim 1 wherein said correlation function is a normalized correlation function.

7. The method of claim 1 further comprising outputting said output signal at a constant rate.

8. The method of claim 7 wherein said constant rate is a real-time rate.

9. The method of claim 7 wherein a location of said beginning of said output block is chosen in dependence on said constant rate.

10. The method of claim 1 further comprising obtaining said input signal at a variable rate.

11. The method of claim 1 wherein (a) is independent of a pitch period of said input signal.

12. The method of claim 1 wherein said overlapping step comprises applying a weighting function to said output block and to said input block.

13. The method of claim 12 wherein said weighting function is a linear function.

14. A method for time scale modification of a multi-channel digital audio input signal, each input channel comprising input samples, to form a multi-channel digital audio output signal, each output channel comprising output samples, said method comprising the steps of:

a) obtaining said input channels;

b) for each of said input channels, independently:

i) selecting an input block of N/2 input samples;

ii) selecting an output block of N/2 output samples from a corresponding one of said output channels;

iii) determining an optimal offset T for an overlap of a beginning of said input block with a beginning of said output block, wherein $-N/2 \leqq T < N/2$, said offset determining comprising calculating a correlation function between discrete frequency transforms of said N/2 input samples and discrete frequency transforms of said N/2 output samples, wherein a maximum value of an inverse discrete frequency transform of said correlation function occurs for said optimal offset T; and iv) overlapping said input block with said output block to form said corresponding output channel, wherein said input block beginning is offset from said output block beginning by T samples; and c) combining said output channels to form said multi-channel digital audio output signal.

15. The method of claim 14 wherein step (a) comprises separating said multi-channel digital audio signal into said input samples.

16. The method of claim 14 wherein step (a) comprises generating said input channels from a single-channel digital audio input signal.

17. The method of claim 16 wherein said input channels are separated from each other by a predetermined time lag.

18. The method of claim 14 wherein said discrete frequency transforms are discrete Fourier transforms, and wherein said inverse discrete frequency transform is an inverse discrete Fourier transform.

19. The method of claim 14 further comprising outputting said multi-channel digital audio output signal at a constant rate.

20. The method of claim 19 wherein said constant rate is a real-time rate.

21. The method of claim 19 wherein, for each channel, a location of said beginning of said output block is chosen in dependence on said constant rate.

22. The method of claim 14 further comprising obtaining said multi-channel digital input signal at a variable rate.

23. The method of claim 14 wherein step (b) (i) is independent of a pitch period of said input channel.

24. The method of claim 14 wherein said multi-channel digital audio input signal and said multi-channel digital audio output signals are stereo signals.

25. A digital signal processor comprising a processing unit configured to perform method steps for time scale modification of a digital audio input signal comprising input samples to form a digital audio output signal comprising output samples, said method steps comprising:

a) selecting an input block of N/2 input samples;

b) selecting an output block of N/2 output samples;

c) determining an optimal offset T for an overlap of a beginning of said input block with a beginning of said output block, wherein $-N/2 \leqq T < N/2$, wherein said offset determining comprises calculating a correlation function between discrete frequency transforms of said N/2 input samples and discrete frequency transforms of said N/2 output samples, wherein a maximum value of an inverse discrete frequency transform of said correlation function occurs for said optimal offset T; and d) overlapping said input block with said output block to form said output signal, wherein said input block beginning is offset from said output block beginning by T samples.

26. The digital signal processor of claim 25 wherein said offset determining step further comprises appending N/2 zero samples to said N/2 input samples before performing said input frequency transforms, and appending N/2 zero samples to said N/2 output samples before performing said output frequency transforms.

27. The digital signal processor of claim 25 wherein said discrete frequency transforms are discrete Fourier transforms, and wherein said inverse discrete frequency transform is an inverse discrete Fourier transform.

28. The digital signal processor of claim 27 wherein said offset determining step comprises:

i) performing a discrete Fourier transform of said input samples to obtain X(k), for k=0, . . . , N/2−1;

ii) performing a discrete Fourier transform of said output samples to obtain Y(k), for k=0, . . . , N/2−1;

iii) performing a complex conjugation of X(k) to obtain X*(k), for k=0, . . . , N/2−1;

iv) calculating a complex multiplication product $Z(k)=X^*(k)\cdot Y(k)$, for k=0, . . . , N/2−1;

v) performing an inverse discrete Fourier transform of Z(k) to obtain z(t); and vi) determining T for which z(T) is a maximum.

29. The digital signal processor of claim 25 wherein said discrete frequency transforms are selected from the group consisting of discrete cosine transforms, discrete sine transforms, discrete Hartley transforms, and discrete transforms based on wavelet basis functions.

30. The digital signal processor of claim 25 wherein said correlation function is a normalized correlation function.

31. The digital signal processor of claim 25 wherein said method steps further comprise outputting said output signal at a constant rate.

32. The digital signal processor of claim 31 wherein said constant rate is a real-time rate.

33. The digital signal processor of claim 31 wherein a location of said beginning of said output block is chosen in dependence on said constant rate.

34. The digital signal processor of claim 25 wherein said method steps further comprise obtaining said input signal at a variable rate.

35. The digital signal processor of claim 25 wherein step (a) is independent of a pitch period of said input signal.

36. The digital signal processor of claim 25 wherein said overlapping step comprises applying a weighting function to said output block and to said input block.

37. The digital signal processor of claim 36 wherein said weighting function is a linear function.

* * * * *